US005927595A

United States Patent [19]

Mellon et al.

[11] Patent Number: 5,927,595

[45] Date of Patent: Jul. 27, 1999

[54] MULTI-USE ENVELOPE

[75] Inventors: Mark Mellon, Bear; William R. Rigby, Newark, both of Del.; Arthur J. Thomas, Alpharetta, Ga.

[73] Assignee: Westvaco Corporation, New York, N.Y.

[21] Appl. No.: 09/118,966

[22] Filed: Jul. 20, 1998

[51] Int. Cl.[6] ..... B65D 27/06

[52] U.S. Cl. ..... 229/302; 229/305

[58] Field of Search ..... 229/302, 300, 229/301, 309, 311, 305

[56] References Cited

U.S. PATENT DOCUMENTS

| | | | |
|---|---|---|---|
| 1,896,425 | 2/1933 | Scarfi | 229/311 |
| 2,859,907 | 11/1958 | McFarland | 229/309 |
| 2,962,205 | 11/1960 | McFarland | 229/309 |
| 2,964,233 | 12/1960 | McFarland | 229/302 |
| 4,308,987 | 1/1982 | Solomon | 229/73 |
| 4,382,539 | 5/1983 | Kronman | 229/73 |
| 4,993,752 | 2/1991 | Juszak | 229/300 |
| 5,400,957 | 3/1995 | Stude | 229/303 |
| 5,503,328 | 4/1996 | Roccaforte et al. | 229/301 |
| 5,683,029 | 11/1997 | Lyons | 229/309 |
| 5,799,865 | 9/1998 | Gray | 229/309 |

FOREIGN PATENT DOCUMENTS

| | | | |
|---|---|---|---|
| 2253679 | 7/1975 | France | 229/302 |
| 128074 | 6/1919 | United Kingdom | 229/302 |

*Primary Examiner*—Stephen P. Garbe

[57] ABSTRACT

A multi-use envelope for at least two mailings comprises opposed front and rear panels foldably connected together at their bottom edges and secured together at their side edges by side closure flaps to form an envelope structure. The improvement comprises a pair of closure flaps foldably attached respectively to the top edges of each of the front and rear panels wherein each closure flap has an independent means for sealing and opening the envelope. A first closure flap is folded inside the envelope for the first mailing while the other closure flap is used to close the envelope. Upon receipt, the first closure flap is folded outside the envelope for use in closing the envelope for the second mailing.

3 Claims, 1 Drawing Sheet

MULTI-USE ENVELOPE

BACKGROUND OF INVENTION

The present invention relates generally to a multi-use envelope. Multi-use is defined as having the ability to be used more than once, for example, for return mail or for a second mailing to a new recipient.

Return mail or two way envelopes which eliminate the need for enclosing a return envelope to facilitate replying to the original sender are well known. Examples of such envelopes are disclosed for example in U.S. Pat. Nos. 4,308,987 and 4,382,539. Likewise, envelopes capable of being used for a second mailing are also well known. Examples are disclosed in U.S. Pat. Nos. 5,400,957 and 5,503,328. As will be noted from an examination of these second two patents, both the first and second mailing features are generally provided in a single large closure flap, although the '328 patent also discloses such features incorporated into two adjacent flaps, or two opposed side flaps. Nevertheless, the envelopes disclosed in the prior art have failed to achieve significant commercial success either because of the complexity and expense of manufacture or because they are difficult and complicated to use.

SUMMARY OF INVENTION

It is therefore, an object of the present invention to provide an improved multi-use envelope which is inexpensive to manufacture and easy to use in practice. The present invention contemplates the use of independent closure flaps each having its own closing and opening means. In a preferred embodiment, each closure flap is provided with an adhesive patch for closing the envelope and a separate tear strip for opening the envelope after each use. In another embodiment, useful for making the envelope easier to recycle, a single strip of tear tape may be used for both the closing and opening of each closure flap. For this purpose, the tear tape is two-sided, i.e., it has adhesive applied to both sides. One adhesive coated side of the two-sided tear tape is applied to an inner surface of each closure flap while the other adhesive coated side is protected until use by a removable protective strip. The tear tape is preferably stronger than the material from which the envelope is constructed (typically paperboard), and is strong enough so that it will tear through the closure flap for opening the envelope when desired. Meanwhile, the adhesive bond between the tear tape and the envelope panel to which it is bonded to close the envelope is sufficiently strong that, when the envelope is opened, the tear tape will delaminate from the panel to which it is bonded with some fiber tear.

In a preferred embodiment of the invention the envelope is constructed from a paperboard blank which includes a pair of primary panels, side closure flaps and a pair of independent closure flaps, one connected to each primary panel. Prior to the first mailing, one of the closure flaps is tucked inside the envelope structure, formed by the two primary panels and the side closure flaps, and the other closure flap is used to close the envelope. Upon receipt by the first recipient, the sealed closure flap is opened, and for the second mailing, the other closure flap is untucked from the envelope structure where it may be used to close the envelope for the second mailing. In addition, in order to provide versatility in addressing the envelope for each use, and also to improve recyclability, it is contemplated that one or both of the outer surfaces of the primary panels be printed with a release coating for attaching an address label. After the first mailing, the address label for the first recipient could be removed and a new label applied, either on the other primary panel or in the same location on the first primary panel, for the second mailing. Upon receipt by the second recipient, the address label(s) could then be readily removed for recycling.

It is therefore, a primary object of the present invention to provide a multi-use envelope which is simple in operation and use.

Another object of the present invention is to provide a multi-use or remailable envelope which has independent closing and opening means for each mailing.

Other objects and advantages of the invention will become apparent with reference to the accompanying drawings.

DETAILED DESCRIPTION

Figure 1:
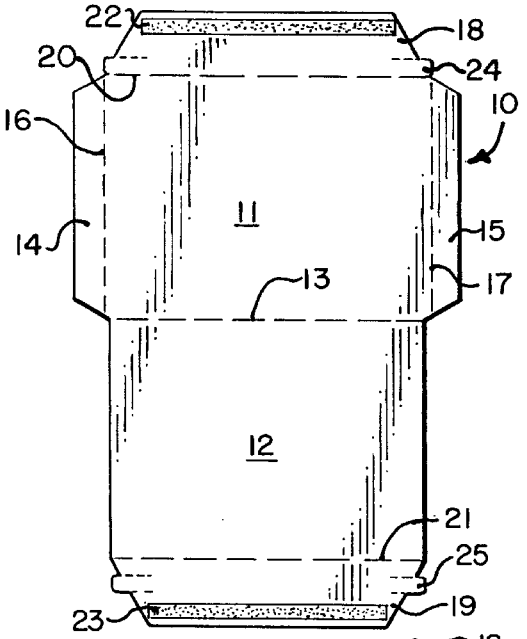
FIG. 1 is a plan view of a typical blank structure for forming an envelope according to the present invention.

The invention will now be described with reference to the drawings in which FIG. 1 illustrates a typical blank structure comprising paper, paperboard or the like, and generally designated by numeral 10. Blank 10 includes a pair of primary panels 11 and 12 (arbitrarily designated as front and rear panels), separated from one another by a fold line 13. A pair of side closure flaps 14, 15 are illustrated as being foldably attached to front panel 11 along fold lines 16, 17, although the same flaps could just as readily be attached to rear panel 12. Meanwhile, a pair of independent and separate closure flaps 18 and 19 are foldably attached, respectively, to panels 11 and 12 along score lines 20, 21. In the illustrated embodiment of the invention, each closure flap has applied thereto adhesive patches 22, 23, and each closure flap includes its own removable tear strip 24, 25 for opening the envelope. Tabs are provided for easy access to the tear strips 24, 25 at the outer edges of the closure flaps 18 and 19.

Figure 2:
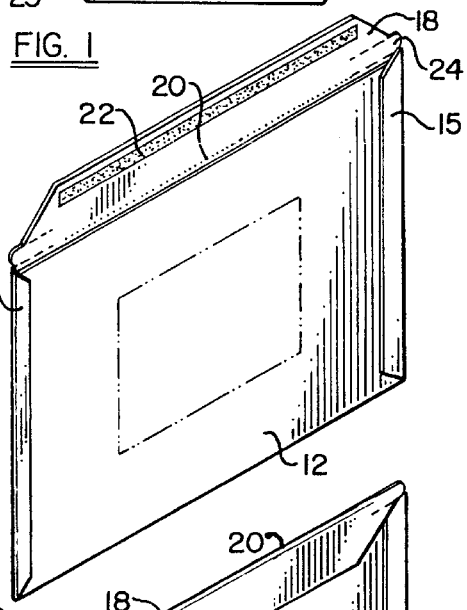
FIG. 2 is a perspective view of the envelope formed from the blank of FIG. 1.
Figure 3:
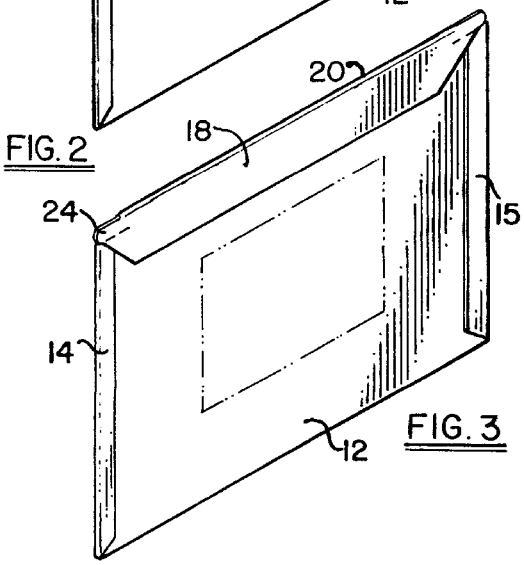
FIG. 3 shows the envelope closed for its first mailing.

FIG. 2 illustrates the blank 10 of FIG. 1 folded and ready for first mailing. For this purpose, closure flap 19 is folded over and tucked inside the envelope structure when the side closure flaps 14, 15 are adhered to panel 12. The side closure flaps may be adhered either to the outer surface or the inner surface of panel 12 as desired. After the envelope is filled, closure flap 18 is folded over about score line 20 and sealed to panel 12 for the first mailing. In the embodiment shown, a protective strip applied over adhesive patch 22 would be removed to provide access to the adhesive 22. Also as shown in dotted lines on the drawing, starter perforations are included in each closure flap adjacent to the tear strips 24, 25 to assist in opening the envelope. In addition (and not shown), it is contemplated that the tear strips 24, 25 could be replaced with a two-sided tear tape as described hereinbefore. This modified structure would eliminate the need for separate adhesive strips on each closure flap as shown. FIG. 3 shows the envelope closed and ready for mailing. In this connection, it is contemplated that a patch of release coating be printed on the outer surfaces of panels 11 and 12 (shown for example in phantom lines) for accepting an address label.

An example of such a coating that could be pattern printed on the primary panels using a printing press is an acrylic coating supplied by Dessuek Campbell, Inc.

Figure 4:
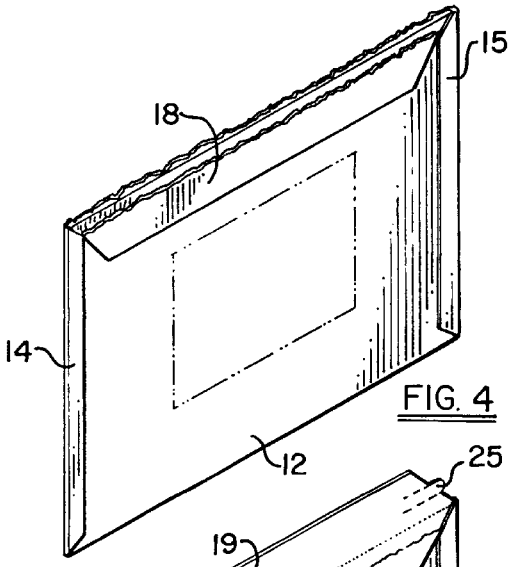
FIG. 4 shows the envelope opened after the first mailing.
Figure 5:
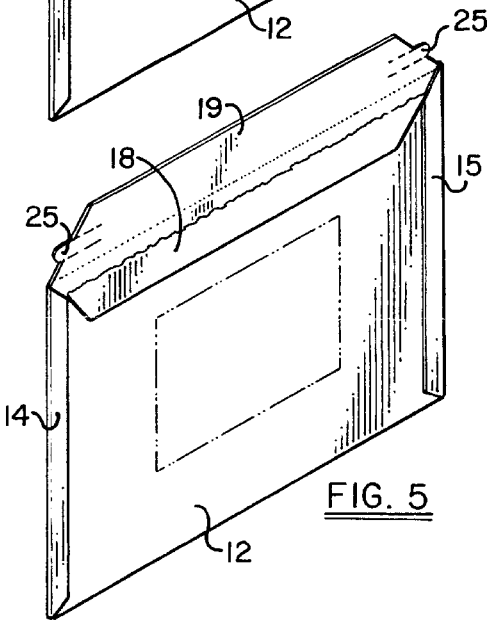
FIG. 5 shows the envelope ready for its second mailing.
Figure 6:
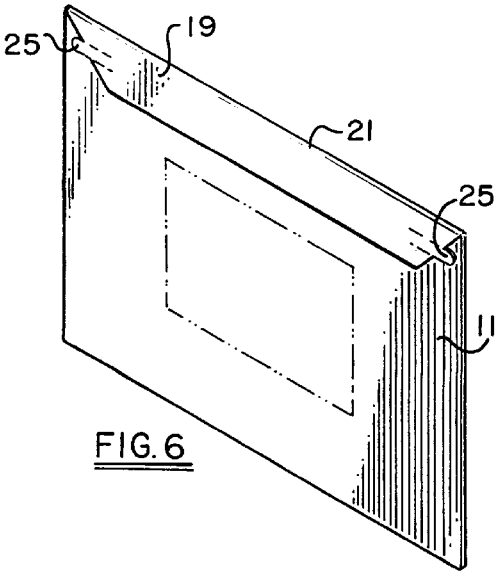
FIG. 6 shows the envelope closed for the second mailing.

Upon receipt of the envelope by the first addressee, the envelope would be opened as shown in FIG. 4 by removing tear strip 24. For the embodiment shown, this would leave a portion of the closure flap 18 still adhered to panel 12. However, if a two sided tear tape was used to close the envelope as mentioned hereinbefore, removal of the tear tape would effectively remove substantially the entirety of the closure flap. Also, the first addressee could remove the address label because of the presence of the release coating, and prepare the envelope for its second use by untucking closure flap 19 from within the envelope structure as shown in FIG. 5. At this point in time, the envelope would be ready for its second use. After filling, the envelope could be closed by folding closure flap 19 over about score line 21 to be adhered to panel 11 as shown in FIG. 6.

Obviously, many modifications and variations of the present invention will be apparent to those skilled in the art in light of the above description. For example, it is contemplated that the panels and flaps of the envelope could be of different design or arranged on the panels differently, that the envelope may or may not contain written or printed indicia (e.g., instructions for use, etc.), and that the envelope may be provided with windows as desired. It is, therefore, to be understood that within the scope of the appended claims, the invention may be practiced otherwise than as specifically described herein.

What is claimed is:

1. A multi-use envelope having an envelope structure comprising:

(a) a first primary panel having an inner surface and an outer surface;

(b) a second primary panel having an inner surface and an outer surface connected to the first panel along a first fold line, wherein the outer surface of at least one of said first or second primary panels is printed with a release coating for adhering an address label;

(c) side closure flaps foldably attached to one of said first or second primary panels at each side thereof and adhered to the other of said primary panels to form an envelope structure having an interior and an exterior;

(d) a first closure flap foldably connected to said first primary panel along a second fold line remote from and substantially parallel to said first fold line;

(e) a second closure flap foldably connected to said second primary panel along a third fold line remote from and substantially parallel to said first and second fold lines, wherein one of said closure flaps is tucked interiorly of the envelope structure during the first mailing and untucked for use during the second mailing; and, (f) independent means associated with each of said first and second closure flaps for closing and opening the envelope during at least two mailings of said envelope.

2. The multi-use envelope of claim 1 wherein the independent means for closing and opening the envelope for each mailing comprises separate adhesive and tear strips incorporated in each closure flap.

3. The multi-use envelope of claim 1 wherein the independent means for closing and opening the envelope for each mailing comprises a single elongated strip of tear tape having two adhesive surfaces incorporated in each closure flap.

* * * * *